United States Patent [19]

Lochet

[11] Patent Number: 4,744,871

[45] Date of Patent: May 17, 1988

[54] ELECTROLYTE SOLUTION AND PROCESS FOR GOLD ELECTROPLATING

[75] Inventor: Jean A. Lochet, Metuchen, N.J.

[73] Assignee: Vanguard Research Associates, Inc., South Plainfield, N.J.

[21] Appl. No.: 56,546

[22] Filed: Jun. 1, 1987

Related U.S. Application Data

[63] Continuation-in-part of Ser. No. 912,171, Sep. 25, 1986, Pat. No. 4,670,107, which is a continuation of Ser. No. 836,240, Mar. 5, 1986, abandoned.

[51] Int. Cl.[4] ..... C25D 3/48; C25D 3/62

[52] U.S. Cl. ..... 204/44.3; 204/47.5

[58] Field of Search ..... 204/44.3, 47.5

[56] References Cited

U.S. PATENT DOCUMENTS

| | | | |
|---|---|---|---|
| 3,149,057 | 9/1964 | Parker | 204/47.5 |
| 3,149,058 | 9/1964 | Parker | 204/47.5 |
| 3,776,822 | 12/1973 | Baker | 204/47.5 |
| 3,893,896 | 7/1975 | Korbelak et al. | 204/44 |
| 3,929,595 | 12/1975 | Biberbach et al. | 204/44 |
| 4,075,065 | 2/1978 | Korbelak et al. | 204/44.3 |
| 4,436,595 | 3/1984 | Matson | 204/40 |
| 4,615,774 | 10/1986 | Somers et al. | 204/44.3 |
| 4,670,107 | 6/1987 | Lochet | 204/44.3 |

OTHER PUBLICATIONS

"Continuous Reel-to-Reel Plating for the Electronics Industry", by Jean A. Lochet et al, an American Electronics Society Lecture, (1983).

*Primary Examiner*—G. L. Kaplan

*Attorney, Agent, or Firm*—Stefan J. Klauber

[57] ABSTRACT

Gold plating baths comprising a nickel or cobalt brightener/hardener, containing a dicarboxylic acid having the formula HOOC—$(CH_2)_n$—COOH in which n is an integer from 1 to 4 and mixtures thereof, an acid selected from the group consisting of malic acid, gluconic acid and formic acid and mixtures thereof, plus optionally oxalic acid, enable the use of high current densities with attainment of improved efficiencies in producing bright deposits; also enable bright deposits to be obtained at high temperatures of about 150° F.

24 Claims, No Drawings

ELECTROLYTE SOLUTION AND PROCESS FOR GOLD ELECTROPLATING

FIELD OF THE INVENTION

This application is a continuation-in-part of Ser. No. 912,171 filed Sept. 25, 1986 and now U.S. Pat. No. 4,670,107 which in turn was a continuation of Ser. No. 836,240 filed Mar. 5, 1986 and now abandoned.

This invention relates to the electrodeposition of gold from an aqueous gold cyanide plating bath. More particularly, it relates to obtaining bright gold deposits with excellent physical properties, e.g. without degradation of the quality of the deposit, under plating conditions including the presence of a nickel or cobalt brightener/hardener, at high plating speeds.

BACKGROUND OF THE INVENTION

Commercially, parts to be plated can be plated on a continuous basis on reel-to-reel selective plating machines, see "Continuous Reel-to-Reel Plating for the Electronics Industry" by Jean Lochet et al, an AES Electronics Lecture. Such machines are very expensive and perform all the plating steps on a continuous basis, including cleaning, activation, undercoating, and final plating of the parts by processing the parts, in successive steps, through the complete plating cycle. Basically, their processing speed is only limited by the deposition speed, i.e. the ability of the plating baths to produce acceptable deposits of required thicknesses rapidly. It can be seen as a matter of economics that high deposition rates are highly desirable, since the higher the production is, the lower the unit cost becomes.

As a general rule, higher gold concentrations permit higher efficiency, current densities and plating rates. However, for economic reasons (lower inventory, lower drag out, etc.) gold contents should be kept as low as possible.

It will be understood that higher current densities mean higher rates of deposition, since theoretically one ampere will deposit a definite amount of metal in one second. A further consideration is that the current efficiency, expressed as mg/ampere-minute, when reduced to very small values, renders the buildup of thick bright deposits difficult or impossible in high speed applications in which thick deposits have to be built up in a very short time, termed "retention time". That is, the low current efficiency works oppositely to the effect of high current density. Further, as stated in U.S. Pat. No. 4,436,595 at column 3, lines 25–29, the lower the temperature, the brighter the deposit, but the slower the plating speed, and vice versa; and as a compromise between brightness and plating speed, an operating temperature of 130° F. is preferred. In fact, in practice, very few if any known acid gold plating baths give bright deposits at 150° F., whereas, as will be seen in the ensuing description, the reverse is true for the baths of the present invention.

It is an object of the invention to achieve improvements in the high speed plating of gold including increased current efficiency and lower content of cobalt or nickel hardeners in the plated deposit.

The use of nickel or cobalt chelates as brightener/hardeners is taught in U.S. Pat. Nos. 3,149,057 and 3,149,058. The use of aliphatic acids of 2 to 8 carbon atoms such as acetic, citric, tartaric, etc., when properly neutralized to act as buffers to maintain a pH between 3 and 5, is described.

U.S. Pat. No. 3,929,595 which is directed to employing a heterocyclic azohydrocarbon sulfonic acid or salt current extender, and a reduced amount of non-noble metal additions, also discloses the use of a weak organic acid, preferably citric or tartaric acid. It mentions that additional suitable weak organic acids include formic acid, lactic acid, kojic acid, itaconic acid, citraconic acid, gluconic acid, glutaric acid, glycolic acid, acetic acid and propionic acid.

U.S. Pat. Nos. 3,893,896 and 4,075,065 disclose alkali metal gold cyanide plating baths containing a metallic hardener such as cobalt citrate and nickel sufamate, a Lewis acid such as boric acid, zirconium oxychloride and vanadyl sulphate, and a weak, stable aliphatic acid containing one or more carboxylic acid or hydroxy groups. It discloses as suitable organic acids, itaconic, citraconic, gluconic, glutaric, glycolic, citric, kojic, malic, succinic, lactic, tartaric and mixtures thereof.

U.S. Pat. No. 4,615,774 discloses a citrate-free bath for the electrodeposition of a gold alloy, which bath consists essentially of a bath soluble source of gold in an amount to provide a gold content of 4 to 50 g/l, a bath soluble source of nickel alloying metal in an amount to provide a nickel content of 0.5 g/l, oxalic acid in an amount of 20 to 100 g/l, and formic acid in an amount of 20 to 100 ml/l.

Also of interest is U.S. Ser. No. 912,171 filed Sept. 25, 1986, of which this application is a continuation-in-part, incorporated herein by reference, which discloses a gold plating bath comprising an aqueous solution containing a soluble gold cyanide compound, a water soluble organophosphorous chelating agent, formic acid in a specified concentration, cobalt or nickel which may be introduced as their salts or chelates as brightener/hardeners and sufficient alkali to bring the pH to within a specified range.

As described therein, the plating may be accomplished by any of the commercial means available such as barrel, rack and strip plating equipment and high speed continuous selective plating equipment. The products are useful for industrial purposes, especially for making electrical connections, e.g. as connectors. Depending on the type of equipment used, plating may be carried out at temperatures in the range of 90° to 160° F. and at current densities from about 0.5 to in excess of 1000 ASF.

SUMMARY OF THE INVENTION

According to the invention a citrate-free electroplating bath for the deposition of gold, useful for high plating speed applications, (citrates are not desirable for high speed applications) comprises an aqueous solution containing at least one soluble gold cyanide compound, a dicarboxylic acid having the formula $HOOC—(CH_2)_n—COOH$ in which n is an integer from 1 to 4, e.g., malonic, succinic, glutaric and adipic acid, and mixtures thereof, an acid selected from the group consisting of malic acid, gluconic acid and formic acid and mixtures thereof, plus optionally acid, a brightener/hardener selected from the group consisting of nickel and cobalt compounds and sufficient alkali to bring the pH to within the range of about 3.5 to about 4.8, preferably about 3.8 to 4.2. When formic acid is used it is preferred that malic acid be present also. The concentration of said dicarboxylic acid of the formula shown is general is within the range of about 30 to about 150 grams per liter of the bath solution but within the solubility limits of said dicarboxylic acid in the bath solution. The following table shows the physical properties of some dibasic acids.

TABLE

PHYSICAL CONSTANTS OF DIBASIC ACIDS

| Name | Formula | M.P. °C. | Sol. g./100 g. $H_2O$ | $K_1$ | $K_2$ |
|---|---|---|---|---|---|
| Oxalic | HOOC—COOH | 189. | $10.2^{20}$ | $5.7 \times 10^{-2}$ | $6.9 \times 10^{-5}$ |
| Malonic | HOOC—$CH_2$—COOH | 135.6 | $139.4^{15}$ | $1.7 \times 10^{-3}$ | $1.0 \times 10^{-6}$ |
| Succinic | HOOC—$(CH_2)_2$COOH | 185. | $6.84^{20}$ | $6.65 \times 10^{-5}$ | $2.3 \times 10^{-6}$ |
| Glutaric | HOOC—$(CH_2)_3$COOH | 97.5 | $83.3^{14}$ | $4.75 \times 10^{-5}$ | $2.7 \times 10^{-6}$ |
| Adipic | HOOC—$(CH_2)_4$COOH | 151. | $1.44^{15}$ | $3.76 \times 10^{-5}$ | $2.4 \times 10^{-6}$ |
| Pimelic | HOOC—$(CH_2)_5$COOH | 103. | $4.1^{20}$ | $3.48 \times 10^{-5}$ | $3.23 \times 10^{-6}$ |
| Suberic | HOOC—$(CH_2)_6$COOH | 140. | $0.142^{15.5}$ | $2.99 \times 10^{-5}$ | $2.5 \times 10^{-6}$ |
| Azelaic | HOOC—$(CH_2)_7$COOH | 106.5 | $0.214^{20}$ | $2.96 \times 10^{-5}$ | $2.7 \times 10^{-6}$ |
| Sebacic | HOOC—$(CH_2)_8$COOH | 134.5 | 0.10 | $2.34 \times 10^{-5}$ | $2.6 \times 10^{-6}$ |

The cobalt or nickel may be introduced as their salts or chelates. A chelating agent, either combined with said metal or in free form, is not essential but may be used. When replenisher, i.e. one of the higher molecular weight acids specified, is added, it is preferably introduced in solid form.

Although gold concentrations (calculated as metal) may range from about 2 g/l to about 20 g/l, they may preferably range from about 8 g/l to about 20 g/l for high speed applications.

The temperature of plating may be in the range of about 90° F. to about 160° F., preferably not above 150° F.

Current density may be at least about 0.5 ASF up to about 200 ASF but preferably will be in the range of about 20 ASF to about 120 ASF.

DETAILED DESCRIPTION

The invention will be described with reference to the ensuing examples which are intended to be illustrative but not limitative.

The testing method used basically employs a 1 liter beaker with platinum coated anodes, a thermostatically controlled heater, a means to provide mild agitation and a suitable rectifier in which are plated copper wires of about 1 mm in diameter and 320 mm in length turned around a wood cylinder of 2 mm in diameter.

In general, formulas are prepared by mixing the ingredients, adjusting the pH with KOH to within the range of about 3.8 to about 4.0 and adding water to bring the volume to 1 liter. Data are given for temperature, ASF (amperes per square foot), efficiency in mg (milligrams per ampere-minute) and appearance.

EXAMPLE I

The following bath was prepared and tests were carried out.

| Formula A | 1 liter |
|---|---|
| Malic Acid | 150 grams |
| Succinic acid | 60 grams |
| Potassium hydroxide | to pH 4.0 |
| Co (as EDTA complex)* | 600 mg |
| Au (as PGC)** | 10 mg |

*EDTA is ethylenediamine tetraacetic acid
**PGC is potassium gold cyanide (1) The aforementioned copper wires were plated at 130° F.:

| Current Density | 20 ASF | 40 ASF | 60 ASF | 80 ASF | 120 ASF |
|---|---|---|---|---|---|
| Efficiency, mg | 62.3 | 52 | 43.3 | 34 | 24 |
| Aspect | bright | bright | bright | bright | semi-bright |

The cobalt content of the deposit plated at 60 ASF was 0.183%. The bath turned from a light apricot color to a vivid pink and then to an intense purple.

Wires were plated at 150° F.:

| Current Density | 20 ASF | 40 ASF | 60 ASF | 80 ASF | 120 ASF |
|---|---|---|---|---|---|
| Efficiency, mg | 67.6 | 58.5 | 49.1 | 41.8 | 29.4 |
| Aspect | bright | bright | bright | bright | semi-bright |

The cobalt content of the deposit plated at 60 ASF was 0.162%. The above bath is eminently suitable for high speed plating.

(2) 5 grams of oxalic acid were added to the above bath and the pH readjusted to 4.0.

Wires were plated at 130° F.

| Current Density | 20 ASF | 40 ASF | 60 ASF | 80 ASF | 120 ASF |
|---|---|---|---|---|---|
| Efficiency, mg | 71 | 53.5 | 42.6 | 35.5 | 26.2 |
| Aspect | bright | bright | bright | bright | semi-bright |

The cobalt content of the deposit plated at 60 ASF was 0.151%.

Wires were plated at 150° F.:

| Current Density | 20 ASF | 40 ASF | 60 ASF | 80 ASF | 120 ASF |
|---|---|---|---|---|---|
| Efficiency, mg | 77.36 | 63 | 51.1 | 41.6 | 31.7 |
| Aspect | bright | bright | bright | bright | semi-bright |

The cobalt content of the deposit plated at 60 ASF was 0.131%.

The addition of oxalic acid increased the efficiency of the bath both at 130° and 150° F. As shown in the above example, the deposit cobalt content was also decreased.

EXAMPLE II 10 ml of formic acid (C.P. grade containing approximately 90 weight % formic acid) were added to the bath of test (2) of Example I and the pH adjusted to 4.0. Wires were plated at 130° F.:

| Current Density | 20 ASF | 40 ASF | 60 ASF | 80 ASF | 120 ASF |
|---|---|---|---|---|---|
| Efficiency, mg | 66.6 | 49 | 38.3 | 32 | 23.3 |
| Aspect | bright | bright | bright | bright | semi-bright |

Wires were plated at 150° F.:

| Current Density | 20 ASF | 40 ASF | 60 ASF | 80 ASF | 120 ASF |
|---|---|---|---|---|---|
| Efficiency, mg | 75.6 | 60 | 46.6 | 37.8 | 23 |
| Aspect | bright | bright | bright | bright | semi-bright |

The addition of 10 ml of formic acid decreased the efficiency by 2–5 mg at 20–120 ASF but improved the cosmetic appearance especially at 80–120 ASF.

EXAMPLE III (1) In this series of tests the succinic acid of Example I was replaced by malonic acid. The following bath was prepared.

| Formula B | 1 liter |
|---|---|
| Malic acid | 150 grams |
| Malonic acid | 60 grams |
| Potassium hydroxide | to pH 4.0 |
| Co (as EDTA complex) | 600 mg |
| Au (as PGC) | 10 grams |

The aforementioned copper wires were plated at 130° F.:

| Current Density | 20 ASF | 40 ASF | 60 ASF | 80 ASF | 120 ASF |
|---|---|---|---|---|---|
| Efficiency, mg | 72.3 | 58. | 47.7 | 39 | 29.3 |
| Aspect | bright | bright | bright | bright | semi-bright |

The cobalt content of the deposit plated at 60 ASF was 0.19%.

Wires were plated at 150° F.:

| Current Density | 20 ASF | 40 ASF | 60 ASF | 80 ASF | 120 ASF |
|---|---|---|---|---|---|
| Efficiency, mg | 77.6 | 67.5 | 56.6 | 46.6 | 34.8 |
| Aspect | bright | bright | bright | semi-bright | semi-bright |

The cobalt content of the deposit plated at 60 ASF was 0.162%.

The malonic acid bath exhibits higher efficiency and a significant loss of brightness in the higher current density areas (i.e. semi-bright at 80 ASF and above) but is still suitable for medium to high speed applications.

(2) To compensate for the loss of brightness, the cobalt concentration was increased to 800 mg. Wires were plated at 130° F.:

| Current Density | 20 ASF | 40 ASF | 60 ASF | 80 ASF | 120 ASF |
|---|---|---|---|---|---|
| Efficiency, mg | 56.3 | 47.3 | 41 | 33 | 25 |
| | bright | bright | bright | semi-bright | semi-bright |

The cobalt content of the deposit plated at 60 ASF was 0.214%.

Wires were plated at 150° F.:

| Current Density | 20 ASF | 40 ASF | 60 ASF | 80 ASF | 120 ASF |
|---|---|---|---|---|---|
| Efficiency, mg | 63 | 61 | 51.5 | 43 | 33.7 |
| Aspect | bright | bright | bright | semi-bright | semi-bright |

The cobalt content of the deposit plated at 60 ASF was 0.158%.

(3) Then the cobalt content was increased to 1 gr per liter. Wires were plated at 130° F.

| Current Density | 20 ASF | 40 ASF | 60 ASF | 80 ASF | 120 ASF |
|---|---|---|---|---|---|
| Efficiency, mg | 56.2 | 47.4 | 39.2 | 30.9 | 24.1 |
| Aspect | bright | bright | bright | bright | semi-bright |

The cobalt content of the deposit plated at 60 ASF was 0.225%.

Wires were plated at 150° F.:

| Current Density | 20 ASF | 40 ASF | 60 ASF | 80 ASF | 120 ASF |
|---|---|---|---|---|---|
| Efficiency, mg | 58.8 | 55.5 | 45.1 | 37.6 | 31.4 |
| Aspect | bright | bright | bright | bright | semi-bright |

The cobalt content of the deposit plated at 60 ASF was 0.164%.

Thus, the slight loss of brightness at higher current densities found in test (1) of Example III can be compensated for by an increase in the cobalt concentration in the plating bath, with a slight loss in efficiency and an increase in the cobalt content of the deposit.

(4) 10 grams of oxalic acid were added to the bath of test (3). Wires were plated at 130° F.:

| Current Density | 20 ASF | 40 ASF | 60 ASF | 80 ASF | 120 ASF |
|---|---|---|---|---|---|
| Efficiency, mg | 65 | 52 | 42 | 35 | 26 |
| Aspect | bright | bright | bright | bright | semi-bright |

The cobalt content of the deposit plated at 60 ASF was 0.126%.

Wires were plated at 150° F.:

| Current | 20 ASF | 40 ASF | 60 ASF | 80 ASF | 120 ASF |
|---|---|---|---|---|---|

-continued

| | | | | | |
|---|---|---|---|---|---|
| Efficiency, mg | 66 | 63 | 51 | 42 | 29 |
| Aspect | bright | bright | bright | bright | semi-bright |

The cobalt content of the deposit plated at 60 ASF was 0.11%.

As in Example I, the addition of oxalic acid reduced the cobalt concentration in the deposit, without noticeable effect on the brightness, and slightly increased the efficiency.

In relation to the compositions described in U.S. Ser. No. 912,171 filed Sept. 25, 1986, malic acid or gluconic acid may be used to replace at least in part an organophosphorus chelating agent; a dicarboxylic acid having the formula HOOC—$(CH_2)_n$—COOH in which n is an integer from 1 to 4 may be used to replace at least in part formic acid. The organophosphorus chelating agent is preferably a phosphonic acid. The preferred phosphonic acids are 1-hydroxyethylidene-1,1-diphosphonic acid, sold under the tradename of Dequest 2010 and aminotri(methylene phosphonic acid) sold under the tradename Dequest 2000, both available from the Monsanto Company. The following examples are illustrative.

EXAMPLE IV (1) A portion of the formic acid of a bath containing Dequest 2010 was replaced by succinic acid. The resulting bath had the following formula.

| Formula C | 1 liter |
|---|---|
| Dequest 2010 | 75 ml |
| Malic acid | 75 grams |
| Formic acid | 30 ml |
| Succinic acid | 30 grams |
| Potassium hydroxide | to pH 4.0 |
| Cobalt (as EDTA complex) | 600 mg |
| Au (as PGC) | 10 grams |

The aforementioned copper wires were plated at 130° F.:

| Current | 20 ASF | 40 ASF | 60 ASF | 80 ASF | 120 ASF |
|---|---|---|---|---|---|
| Density | | | | | |
| Efficiency, mg | 83.6 | 58.3 | 45.7 | 36.6 | 25.6 |
| Aspect | semi-bright | bright | bright | bright | semi-bright |

(2) To improve the deposit appearance, the cobalt content was increased to 1 gram per liter. Wires were plated at 130° F.

| Current | 20 ASF | 40 ASF | 60 ASF | 80 ASF | 120 ASF |
|---|---|---|---|---|---|
| Efficiency, mg | 78.2 | 56.5 | 43 | 36 | 25.5 |
| Aspect | bright | bright | bright | semi-bright | semi-bright |

The cobalt content of the deposit plated at 60 ASF was 0.12%.

Wires were plated at 150° F.

| Current Density | 20 ASF | 40 ASF | 60 ASF | 80 ASF | 120 ASF |
|---|---|---|---|---|---|
| Efficiency, mg | 87 | 64.8 | 52.6 | 41.6 | 29.6 |
| Aspect | semi-bright | bright | bright | semi-bright | semi-bright |

The cobalt content of the deposit plated at 60 ASF was 0.113%.

(3) In order to achieve optimum brightness the cobalt was raised to 1.5 gram per liter. Wires were plated at 150° F.

| Current Density | 20 ASF | 40 ASF | 60 ASF | 80 ASF | 120 ASF | 150 ASF |
|---|---|---|---|---|---|---|
| Efficiency, mg | 79 | 60.5 | 47.3 | 38.7 | 27.5 | 23.3 |
| | bright | bright | bright | bright | semi-bright | semi-bright |

The cobalt content of the deposit plated at 60 ASF was 0.117%.

Much more uniform deposits were obtained with a cobalt concentration of 1.5 gram per liter.

EXAMPLE V (1) A bath was prepared with nickel salts replacing cobalt. The bath formulation was:

| Formula D | 1 liter |
|---|---|
| Dequest 2000 | 75 ml |
| Malic acid | 75 grams |
| Formic acid | 30 ml |
| Succinic acid | 30 grams |
| Potassium hydroxide | to pH 4.0 |
| Nickel (as sulfate) | 1 gram |
| Au (as PGC) | 10 grams |

The aforementioned copper wires were plated at 130° F.

| Current Density | 20-ASF | 40 ASF | 60 ASF | 80 ASF | 120 ASF | 150 ASF |
|---|---|---|---|---|---|---|
| Efficiency, mg | 38 | 40 | 34.2 | 29.9 | 23.4 | 19.5 |
| Aspect | bright | bright | bright | bright | semi-bright | semi-bright |

The nickel content of the deposit plated at 60 ASF was 0.782%.

Wires were plated at 150° F.

| Current Density | 20 ASF | 40 ASF | 60 ASF | 80 ASF | 120 ASF | 150 ASF |
|---|---|---|---|---|---|---|
| Efficiency, mg | 39.2 | 43.3 | 39.5 | 34.9 | 28.1 | 23.6 |
| Aspect | bright | bright | bright | bright | semi-bright | semi-bright |

The nickel content of the deposit plated at 60 ASF was 0.87%.

It should be noted that the nickel content in the deposits from the nickel hardened gold compositions of the invention are higher relative to the similar cobalt hardened formulations. The nickel content in the deposit can be advantageously reduced by adding oxalic acid.

(2) 15 grams of oxalic acid were added to the above bath and the pH readjusted to 4.0. Wires were plated at 130° F.

| Current Density | 20 ASF | 40 ASF | 60 ASF | 80 ASF | 120 ASF | 150 ASF |
|---|---|---|---|---|---|---|
| Efficiency, mg | 51 | 45.5 | 38.3 | 31.1 | 25 | 20.5 |
| Aspect | bright | bright | bright | bright | bright | semi-bright |

The nickel content of the deposit plated at 60 ASF was 0.296%.

Wires were plated at 150° F.

| Current Density | 20 ASF | 40 ASF | 60 ASF | 80 ASF | 120 ASF | 150 ASF |
|---|---|---|---|---|---|---|
| Efficiency, mg | 57.5 | 54 | 45.8 | 34.5 | 30.4 | 25 |
| Aspect | bright | bright | bright | bright | bright | semi-bright |

The nickel content of the deposit plated at 60 ASF was 0.464%.

As can be seen, the nickel content is considerably reduced to a more acceptable level.

It will be apparent that the invention is capable of numerous variations without departing from the scope of the invention and without sacrificing its chief advantages.

What is claimed is:

1. A citrate-free bath for the electrodeposition of gold comprising an aqueous solution containing at least one soluble gold cyanide compound, a dicarboxylic acid having the formula HOOC—$(CH_2)_n$—COOH in which n is an integer from 1 to 4 and mixtures thereof, an acid selected from the class consisting of malic acid, gluconic acid and formic acid and mixtures thereof, a hardener selected from the group consisting of nickel and cobalt compounds and sufficient alkali to bring the pH to within the range of about 3.5 to about 4.8.

2. A bath as set forth in claim 1 in which the concentration of said dicarboxylic acid is within the range of about 30 to about 150 grams per liter of the bath solution but within the solubility limits of said dicarboxylic acid in the bath solution.

3. A bath as set forth in claim 1 which additionally comprises oxalic acid.

4. A bath as set forth in claim 1 in which said dicarboxylic acid is succinic acid.

5. A bath as set forth in claim 1 in which said dicarboxylic acid is malonic acid.

6. A bath as set forth in claim 1 in which said dicarboxylic acid is adipic acid.

7. A bath as set forth in claim 1 in which a nickel compound is used.

8. A bath as set forth in claim 1 in which a cobalt compound is used.

9. A bath as set forth in claim 1 in which the gold metal content is within the range of about 2 grams per liter to about 20 grams per liter.

10. A bath as set forth in claim 1 in which the gold metal content is within the range of about 8 grams per liter to about 20 grams per liter.

11. A bath as set forth in claim 1 in which the pH is within the range of about 3.8 to about 4.2.

12. A bath as set forth in claim 1 comprising malic acid and succinic acid.

13. A bath as set forth in claim 12 comprising additionally oxalic acid.

14. A bath as set forth in claim 13 comprising additionally formic acid.

15. A bath as set forth in claim 1 comprising malic acid and malonic acid.

16. A bath as set forth in claim 15 comprising additionally oxalic acid.

17. A citrate-free bath for the electrodeposition of gold comprising an aqueous solution containing at least one soluble gold cyanide compound, a dicarboxylic acid having the formula HOOC—$(CH_2)$—COOH in which n is an integer from 1 to 4 and mixtures thereof, an acid selected from the class consisting of malic acid and gluconic acid and mixtures thereof, a hardener selected from the group consisting of nickel and cobalt compounds and sufficient alkali to bring the pH to within the range of about 3.5 to about 4.8.

18. A bath as set forth in claim 17 which additionally comprises oxalic acid.

19. A bath as set forth in claim 17 in which the pH is within the range of about 3.8 to about 4.2.

20. A bath as set forth in claim 17 which comprises an organophosphorus chelating agent, malic acid, formic acid and succinic acid.

21. A method of electrodepositing gold which comprises electrolyzing a citrate-free solution comprising water, 2–20 grams per liter of gold added as an alkali gold cyanide, a dicarboxylic acid having the formula HOOC—$(CH_2)_n$—COOH in which n is an integer from 1 to 4 and mixtures thereof, an acid selected from the class consisting of malic acid, gluconic acid and formic acid and mixtures thereof, a hardener selected from the group consisting of nickel and cobalt compounds and sufficient alkali to bring the pH to within the range of about 3.5 to about 4.8, said method being carried out at a temperature within the range of about 90° F. to about 160° F. and a current density up to about 200 ASF.

22. A method as set forth in claim 21 in which the current density is in the range of about 20 to about 120 ASF.

23. A method as set forth in claim 22 in which the solution additionally comprises oxalic acid.

24. A method as set forth in claim 22 in which, when replenishing any of the higher molecular weight acids is needed, it is added in solid form.

* * * * *